US010322869B1

(12) United States Patent
Norton

(10) Patent No.: US 10,322,869 B1
(45) Date of Patent: Jun. 18, 2019

(54) NEEDLE NEST

(71) Applicant: Donna Lynn Norton, Arkadelphia, AR (US)

(72) Inventor: Donna Lynn Norton, Arkadelphia, AR (US)

( * ) Notice: Subject to any disclaimer, the term of this patent is extended or adjusted under 35 U.S.C. 154(b) by 0 days.

(21) Appl. No.: 16/179,408

(22) Filed: Nov. 2, 2018

(51) Int. Cl.

| | |
|---|---|
| ***D04B 3/00*** | (2006.01) |
| ***D04B 3/06*** | (2006.01) |
| ***B65D 85/20*** | (2006.01) |
| ***B65D 85/24*** | (2006.01) |
| ***D04B 33/00*** | (2006.01) |

(52) U.S. Cl.
CPC ..... *B65D 85/24* (2013.01); *D04B 33/00* (2013.01); *D04B 3/00* (2013.01); *D04B 3/06* (2013.01)

(58) Field of Classification Search
CPC ..... A45C 11/34; A45C 11/36; A63B 57/20; A63B 57/203; A63B 55/408; B65D 85/24; B25H 3/003; B25H 3/023; B25H 3/026; B65F 1/062; B65F 1/16; D04B 33/00; D04B 3/00; D04B 35/02; D04B 3/06
USPC ..... 220/520, 521; 66/1 A, 1 R, 117; 223/107, 106, 109 R; 132/317, 318, 308, 132/314; 206/392, 391, 759, 259, 443, 206/575; 229/120.2, 120.3, 120.07, 229/160.1, 160.2; 131/329, 231, 251
See application file for complete search history.

(56) References Cited

U.S. PATENT DOCUMENTS 498,455 A * 5/1893 Bartlett ..... B25H 3/003 206/379
1,024,388 A * 4/1912 Bartlett ..... B25H 3/003 206/379
1,061,590 A * 5/1913 Bennet ..... D05B 91/14 223/106
2,325,483 A * 7/1943 Davis ..... A47F 7/0021 206/380
2,412,938 A * 12/1946 Amoth ..... B43K 23/001 211/69.5
2,585,476 A * 2/1952 Lerner ..... D04B 37/00 223/107
2,673,641 A * 3/1954 Carrillo ..... A45D 44/18 132/308
2,958,417 A * 11/1960 Adams ..... A24F 15/18 206/246
2,975,890 A * 3/1961 Block ..... B65D 85/109 206/92
3,052,391 A * 9/1962 Tracy ..... D04B 3/06 223/107
3,084,788 A * 4/1963 Ford ..... D04B 3/00 206/383

(Continued)

*Primary Examiner* — Gideon R Weinerth

(57) ABSTRACT

A four-outer-walled, flat-sided container comprised of a lid and a base, with the majority of the base being an isolated interior storage compartment for handicraft needles and/or miscellaneous other items, either of which are only accessible by opening the lid of the container, and with the balance of the space of the base housing an exterior limited-storage component which can mechanically and independently open-and-close and which presents immediate external access to one or more handicraft needles or other predetermined items without having to open the lid of the container, while none of the needles or other predetermined items or miscellaneous items in any part of the container are an actual part of the invention, is disclosed.

1 Claim, 5 Drawing Sheets

(56) References Cited

U.S. PATENT DOCUMENTS 3,124,399 A * 3/1964 Seta ..... A45D 44/18 312/206
3,322,310 A * 5/1967 Higgs ..... D04B 3/00 206/227
4,163,496 A * 8/1979 Dogliotti ..... B65D 47/0847 206/538
4,478,333 A * 10/1984 Dalbo ..... A45F 3/48 206/380
4,789,059 A * 12/1988 Kim ..... B65D 85/1081 206/246
5,234,108 A * 8/1993 Jorgensen ..... A45C 11/36 206/1.7
5,259,631 A * 11/1993 Brande ..... A45F 3/48 229/120.03
5,489,051 A * 2/1996 Robinson ..... A45F 5/02 206/361
5,692,609 A * 12/1997 Lin ..... A61C 19/02 206/368
5,803,254 A * 9/1998 Vasudeva ..... B25H 3/023 206/373
6,021,891 A * 2/2000 Anderson ..... A45C 11/34 206/214
6,283,291 B1 * 9/2001 Vasudeva ..... B25H 3/003 206/373
6,658,702 B1 * 12/2003 Tucherman ..... A45C 11/34 211/69.1
7,530,459 B2 * 5/2009 Yeh ..... B25H 3/02 206/372
7,565,969 B2 * 7/2009 He ..... B65D 7/06 206/249
D649,032 S * 11/2011 Hearn ..... D9/423
8,800,573 B2 * 8/2014 Hofstad ..... A46B 5/0033 132/289
9,066,543 B2 * 6/2015 Cameron ..... A24F 15/18
9,980,547 B2 * 5/2018 Brown, Jr. ..... A45C 11/34
2001/0052522 A1 * 12/2001 Forest ..... B65D 25/14 220/495.07
2005/0045508 A1 * 3/2005 Lu ..... B25H 3/006 206/372
2005/0218198 A1 * 10/2005 Cavero ..... B65D 5/5253 229/87.05
2005/0241974 A1 * 11/2005 Chen ..... B25H 3/003 206/379
2008/0041863 A1 * 2/2008 Forest ..... B65F 1/0046 220/737
2010/0101279 A1 * 4/2010 Rawls ..... D04B 3/06 66/1 A
2010/0102109 A1 * 4/2010 Flecker ..... B65D 15/08 229/102
2011/0126678 A1 * 6/2011 Hu ..... B25B 13/463 81/63.1
2011/0220654 A1 * 9/2011 Gray ..... B65F 1/062 220/495.06
2013/0105487 A1 * 5/2013 Baik ..... B65F 1/062 220/495.07
2013/0118939 A1 * 5/2013 Meyers ..... B25H 3/021 206/374
2015/0251849 A1 * 9/2015 Yang ..... B65F 1/16 220/661
2018/0222672 A1 * 8/2018 Leon ..... B65F 1/14
2018/0319578 A1 * 11/2018 Elalouf ..... B65D 85/24

* cited by examiner

NEEDLE NEST

BACKGROUND OF THE INVENTION

Field of the Invention

The invention is useful in the field of Fiber Arts & Crafts and/or specialty storage solutions.

Background Art

Fiber crafts artists, like those who knit or crochet, make projects and then may construct and complete them using finishing needles, such as when connecting a project together at a seam, or weaving in and hiding loose yarn ends or tails. Some fiber artists may need more than one type of finishing needle, for example a plastic or metal blunt-end yarn needle, or, a metal sharp-pointed darning needle. Whether plastic or metal, needles are thin and small and should be stored in some type of container to help prevent losing them and/or causing a hazard, and being so thin, a needle can be difficult to pick up from a flat surface with your fingers. A round or tubular needle storage container can easily roll off a surface. Magnetic needle storage containers likely only accommodate metal needles. If the container is also small, the container itself could also easily be misplaced. Additionally, other different types of small items may lack a convenient specialty container.

BRIEF SUMMARY OF THE INVENTION

Fiber artists and needle crafters need a container that is designed to be able to store more than one type and size of finishing needle with the following advantages: 1) the container is non-round and non-tubular so that it sits flat on a surface so that it cannot readily roll off a surface; 2) plastic and/or metal needles can be retrieved from a container without having to open the lid of the container; 3) needles retrieved externally from the container can just as easily be returned to their handy position from where and how they are maintained in place; 4) needles available for external access from the container stay in place even if the container is dropped or turned upside-down; 5) the only reason to ever open the lid of the container is to access the isolated interior storage compartment of the container to retrieve internally stored extra needles and/or miscellaneous other items; 6) the container itself is designed as a convenient, handy size that is not unnecessarily large, but also not so small that the container itself could also easily be misplaced. Additionally, there could be room for a convenient specialty container for other types of predetermined small products. In conclusion, this invention solves deficiencies in prior art and also provides additional new features and new advantages. It is a convenient storage container designed to have an innovative additional exterior storage component that is similar to a "dispenser" built right into one side of the container that manually opens and closes by simply manually pressing either the upper or lower area of the exterior storage component, thereby providing instant presentation and access to one or more different types of predetermined craft needles or other predetermined miscellaneous small products without having to open the lid of the container. The advantages, features and other aspects of the invention will become more fully understood with reference to the following drawings, description and claim.

DETAILED DESCRIPTION OF THE INVENTION

Figure 1A:
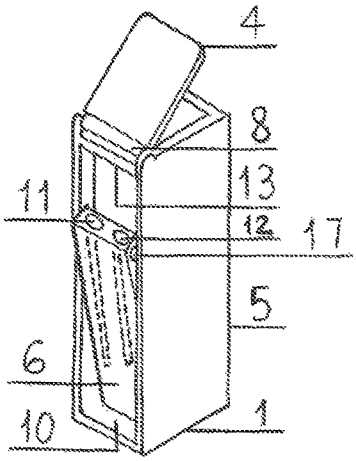
FIG. 1A is an illustration of an end, side and top view, showing the Container to have an open Lid and open Exterior Limited-Storage Component, the Base, the "Ceiling" which is actually the underside of the "Trough-Like" Design Element, the Housing Area for the Exterior Limited-Storage Component of the Container, the "Rod-Like" Design Element which is built into the Lid, one of the four Round Protrusion Embodiments designed into the sides of the Exterior Limited-Storage Component of the Container, two Embedded Cavities in the Exterior Limited-Storage Component that are each permanently open at the top wall of the Exterior Limited-Storage Component, and with the illustration also symbolically showing with broken lines the internal depth of the two Embedded Cavities.
Figure 1B:
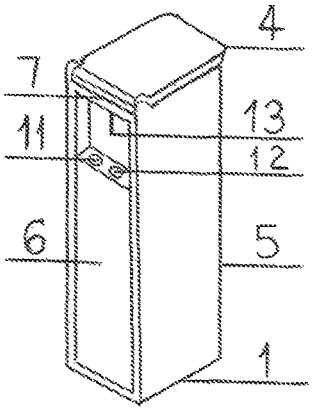
FIG. 1B is an illustration of an end, side and top view, showing the Container to have a closed Lid and closed Exterior Limited-Storage Component, the Base, the "Trough-Like" Design Element, the "Ceiling" which is actually the underside of the "Trough-Like" Design Element, and two Embedded Cavities in the Exterior Limited-Storage Component that are each permanently open at the top of the Embedded Cavities.
Figure 2:
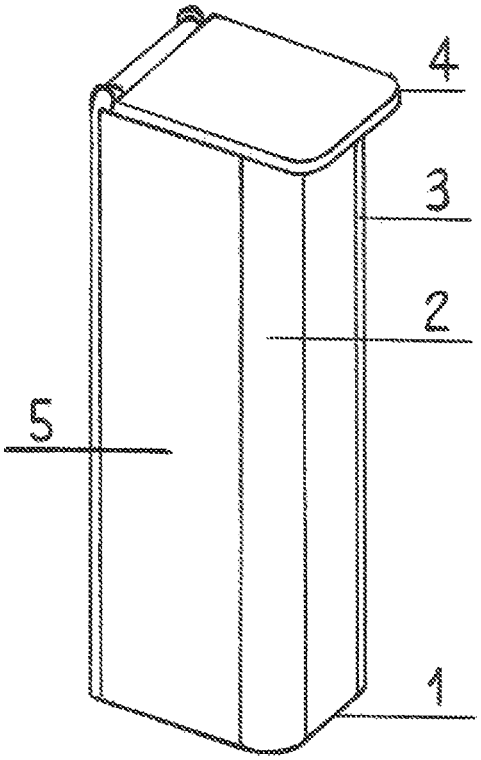
FIG. 2 is an illustration of an end, side and top view, showing the Container to have a closed Lid and closed Exterior Limited-Storage Component, the Base, and which illustrates the Container as a modified design version whereby two of the corners of the Container are rounded instead of squared.
Figure 3:
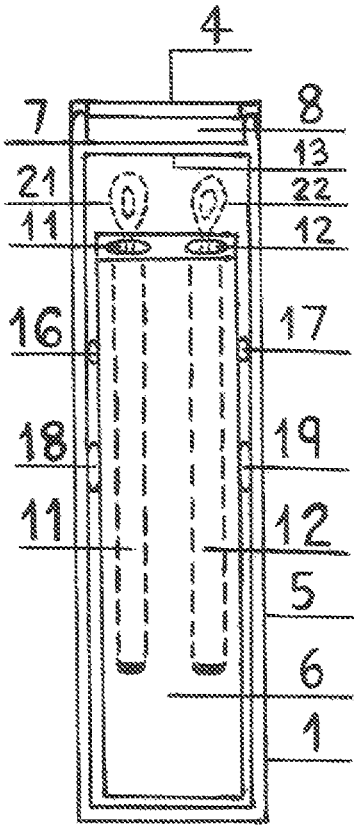
FIG. 3 is an illustration of an end view showing the Container to have a closed Lid and closed Exterior Limited-Storage Component, the Base, the "Rod-Like" Design Element, the "Trough-Like" Design Element, the "Ceiling" which is actually the underside of the "Trough-Like" Design Element, two Embedded Cavities located in the Exterior Limited-Storage Component which are each permanently open at the top wall of the Exterior Limited-Storage Component, and with the illustration also symbolically showing with broken lines the internal depth of the two Embedded Cavities as well as the exposed part of a symbolic needle in each cavity, and four Round Protrusion Embodiments.
Figure 4A:
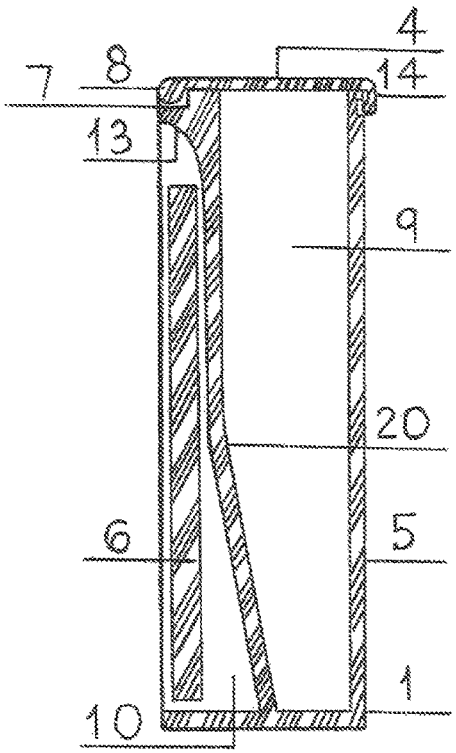
FIG. 4A is an illustration of a cross-section of a side view of the Container which shows both the Lid and Exterior Limited-Storage Component in the closed position, the Base, the "Ceiling," which is actually the underside of the "Trough-Like" Design Element, the "Trough-Like" Design Element, the "Rod-Like" Design Element, the Housing Area for the Exterior Limited-Storage Component of the Container, the Male Open-and-Close Snap-Fit Embodiment in the Lid, the Interior Storage Compartment of the Container, the Separator Wall which shows how the Interior Storage Compartment is a completely separate part inside the Base and how the Separator Wall also serves as one of the four walls that form the Interior Storage Compartment of the Container.
Figure 4B:
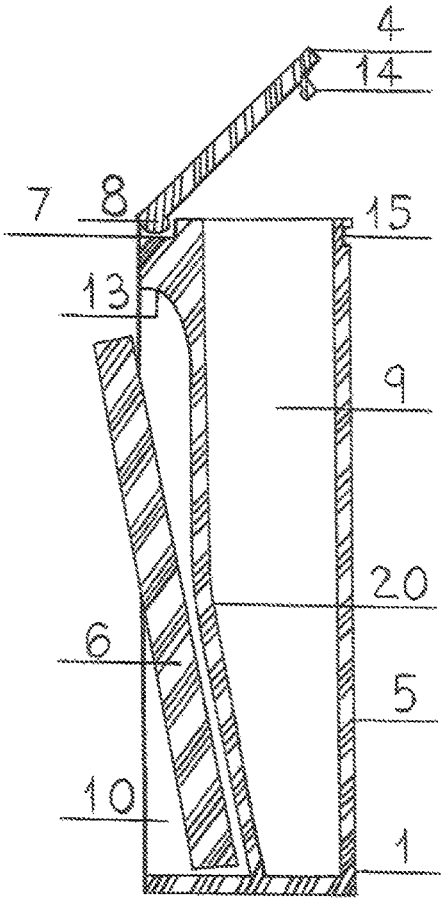
FIG. 4B is an illustration of a cross-section of a side view of the Container which shows both the Lid and Exterior Limited-Storage Component in the open position, the Base, the "Ceiling," which is actually the underside of the "Trough-Like" Design Element, the "Trough-Like" Design Element, the "Rod-Like" Design Element, the Housing Area for the Exterior Limited-Storage Component of the Container, the Female Open-and-Close Snap-Fit Embodiment in the Base, the Male Open-and-Close Snap-Fit Embodiment in the Lid, the Interior Storage Compartment of the Container, the Separator Wall which shows how the Interior Storage Compartment is a completely separate part inside the Base and how the Separator Wall also serves as one of the four walls that form the Interior Storage Compartment of the Container.
Figure 5:
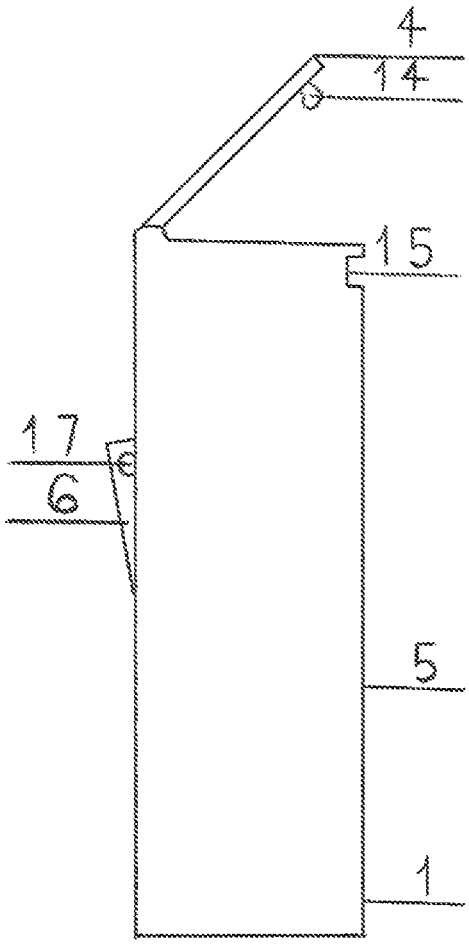
FIG. 5 is an illustration of a side view of the Container, which shows both the Lid and Exterior Limited-Storage Component in the open position, the Base, the Female Open-and-Close Snap-Fit Embodiment in the Base, the Male Open-and-Close Snap-Fit Embodiment in the Lid which together facilitate the Lid opening and closing mechanism, and one of the four Round Protrusion Embodiments designed into the sides of the Exterior Limited-Storage Component of the Container.

The following detailed description represents the best currently contemplated modes for fabricating a two-embedded-cavity version of the invention depending on how many are desired to fabricate, and is not to be taken in a limiting sense, such as size, dimensions, or type, amount or location of components, or the type of items desired to use inside the embedded cavities, such as handicraft needles, crayons, chalk, chap stick, lip stick, drill bits, nails, screws, thin spools of thread, small tubes of perfume or medicine, or other similar items, but is described and explained merely for the purpose of illustrating the general principles of the invention when used with predetermined types and sizes of handicraft needles. A fully-functioning actual prototype of both a squared corners version, and a version with two of the four corners of the invention being rounded has been 3-D printed, and both versions fully function as intended. A design with all corners rounded (or "filleted") would only require a different geometric calculation, but the invention would still basically be the same. Referring to FIGS. 1A, 1B and 2, the invention is a flat-sided, four-outer-walled Container 1. The currently contemplated mode of fabrication is for all corners to be squared, but includes an explanation for how to make two of the corners rounded. Referring to FIG. 2, the adjustments required to make two Rounded Corners 2 and 3 would be to round out both the inner and outer of those corners. Referring to FIGS. 1A, 1B and 5, said Container 1 has three major components which are a Lid 4, a Base 5, and an Exterior Limited-Storage Component 6. Said Lid 4 and said Exterior Limited-Storage Component 6 can each snap on-and-off of said Container 1, thereby allowing for easy replacement of either part. The currently contemplated overall measurements of said Container 1 are three and three-fourths inches tall, one-inch wide at each end, and one and one-eighth inch wide at each side. Referring to FIGS. 1B, 3 and 4B, said Lid 4 is attached to said Base 5 using a snap-in attachment assembly whereby a "Trough-Like" Design Element 7 is designed and built into a top end of said Base 5 which accepts a "Rod-Like" Design Element 8 that is designed and built into one matching end of said Lid 4. Said "Trough-Like" Design Element 7 has sockets that match up with the slightly rounded ends of said "Rod-Like" Design Element 8 that is built into said Lid 4. Referring to FIGS. 4A and 4B, a separate, isolated Interior Storage Compartment 9 is designed into, and within, said Base 5, and referring also to FIGS. 1A, 4A and 4B, the balance of the space of said Base 5 becomes a space for housing said Exterior Limited-Storage Component 6, which shall hereafter be referred to as the Housing Area 10. Said Housing Area 10 is created by partially cutting away the outer wall that is not a part of said Interior Storage Compartment 9 by a depth of around three-sixteenth inch to one-fourth inch starting below said Lid 4. Said Exterior Limited-Storage Component 6 can be independently mechanically opened and closed by simply manually pushing the outside upper or lower area of said Exterior Limited-Storage Component 6. Referring to FIGS. 1A, 1B and 3, said Exterior Limited-Storage Component 6 has two vertically Embedded Cavities 11 and 12 that are excavated through, and are permanently open at, the top end of said Exterior Limited-Storage Component 6. Said Exterior Limited-Storage Component 6 has a contemplated measurement of two and three-fourths inches tall by three-fourths inch wide by one-fourth inch of depth. In the case of fabricating just one prototype, computer-generated drawings are used in conjunction with a 3D printer using a plastic resin material for separately "printing out" layer-by-layer the major components that comprise the invention. Because of the layer-by-layer nature of 3D printing, slight adjustments in the design are necessary if an injection mold process is used, which does not affect the overall design or function of the invention. Said plastic resin material for 3D printing may be either clear or an opaque color, with clear material being more expensive. For manufacturing a large quantity of the invention, a mechanized injection mold process may be used by first manufacturing a steel mold from computer-generated drawings. A more cost-effective contemplated type of steel mold for large production is a six-cavity "family" steel mold, which is one mold divided into six sections for producing two of each of the major components of said Container 1 at the same time, which also saves having to make three separate and very expensive steel molds. A polycarbonate plastic material may be used with the injection mold process, but is not limited to such material. Referring to FIGS. 1A, 1B, 3, 4A and 4B, the area of the bottom of said "Trough-Like" Design Element 7 that is located directly above said Embedded Cavities 11 and 12 also serves as what shall hereafter be referred to as the "Ceiling" 13. Said "Ceiling" 13 serves as a barrier above said Embedded Cavities 11 and 12 for preventing what is placed into said Embedded Cavities 11 and 12 from falling out, even when said Container 1 is turned upside-down. Referring to FIGS. 4A, 4B and 5, said Lid 4 has an open-and-close assembly of Male and Female Open-and-Close Snap-Fit Embodiments 14 and 15 which form a mechanical joint system whereby said Male Open-and-Close Snap-Fit Embodiment 14 located directly below said Lid 4 lines up with and deflects and locks into said Female Open-and-Close Snap-Fit Embodiment 15 which is a recess area that is cut out from the outside of said Base 5 which is designed for receiving said Male Open-and-Close Snap-Fit Embodiment 14, which together function as the means for opening and closing said Lid 4. For the currently contemplated mode of fabrication, said Lid 4 is designed to open and close from the end of said Base 5 that is on the opposite end from where said Lid 4 is snapped in and basically permanently attached to said Base 5. Referring to FIGS. 1A, 3 and 5, Round Protrusion Embodiments 16 and 17 that are designed into each side of said Exterior Limited-Storage Component 6 line up with and insert into matching sockets that are built into the side of said Housing Area 10 of said Base 5. Located about five-eighths inch directly below said Round Protrusion Embodiments 16 and 17 are Round Protrusion Embodiments 18 and 19. Said Round Protrusion Embodiments 16 and 17 are located near the top of said Exterior Limited-Storage Component 6. Said Round Protrusion Embodiments 18 and 19 are located in the center of the same edge of said Exterior Limited-Storage Component 6 about five-eighths inch directly below said Round Protrusion Embodiments 16 and 17, but said Round Protrusion Embodiments 16 and 17 are not centered but designed to be nearer to the edge that is closer to the front wall of said Exterior Limited-Storage Component 6. Said Round Protrusion Embodiments 18 and 19 have a slightly larger diameter than said Round Protrusion Embodiments 16 and 17, and line up with and also insert into sockets that are built into the side of said Housing Area 10 of said Base 5. Said Round Protrusion Embodiments 18 and 19 with their matching sockets provide a rotating axis which facilitates the independent mechanical open-and-close function of said Exterior Limited-Storage Component 6, and said Round Protrusion Embodiments 16 and 17 with their matching sockets function together as a close-stop mechanism. Referring to FIGS. 1A, 4A and 4B, as described above, said Exterior Limited-Storage Component 6 is designed to fit and be housed into said Housing Area 10, which is the balance of the space of said Base 5 that is not occupied by said Interior Storage Compartment 9. Said Exterior Limited-Storage Component 6 is completely separated from said Interior Storage Compartment 9 by a Separator Wall 20 which extends from the top of the inside of said Base 5 to the bottom of said Base 5, with said Separator Wall 20 designed to start slanting inwards towards said Interior Storage Compartment 9 starting two inches below said Lid 4, and extending down to the bottom of said Base 5, so that the depth of said Housing Area 10 is two-eighths inch wide at the top and gradually becomes four-eighths inch wide at the bottom of said Base 5. Therefore the measurement of the side at the bottom of said Interior Storage Compartment 9 is five-eighths inch wide, and this design parameter is what will accommodate and allow the mechanical movement of said Exterior Limited-Storage Component 6 so it can move inward or outward for opening and closing when said Exterior Limited-Storage Component 6 is physically pushed in at the outside upper or lower area of said Exterior Limited-Storage Component 6. Said Interior Storage Compartment 9 is meant to be used as an isolated space for internal storage of extra handicraft needles and/or miscellaneous other items such as stitch markers or tweezers, either and all of which are only accessible by opening said Lid 4, and with such said handicraft needles or miscellaneous items not being an actual part of the invention. Referring to FIGS. 1A, 1B and 3, as stated above, two separate tube-shaped, permanently open, said Embedded Cavities 11 and 12 are designed into said Exterior Limited-Storage Component 6, and the diameters of said Embedded Cavities 11 and 12 individually accommodate two predetermined types and sizes of handicraft Needles 21 and 22, but as stated above, such said needles are not a part of the invention. Referring to FIGS. 3, 4A and 4B, said "Ceiling" 13 serves to prevent said predetermined types and sizes of handicraft Needles 21 and 22 from falling out of said Embedded Cavities 11 and 12, even if said Container 1 is turned upside-down. Referring to FIGS. 1A and 3, the currently contemplated design of the invention accommodates a blunt-end handicraft "Plastic Yarn Needle" 21 and a blunt-end handicraft "Metal Yarn Darner Needle" 22, each being close to the same length of two and thirteen-sixteenths inches maximum, and with said Embedded Cavity 11 accommodating said blunt-end handicraft "Plastic Yarn Needle" 21, and said Embedded Cavity 12 accommodating said blunt-end handicraft "Metal Yarn Darner Needle" 22, although either cavity can accommodate either needle. Both said Embedded Cavities 11 and 12 are two and three-eighths inches in length, leaving one-half inch maximum of the top or "eye" of said Needles 21 and 22 exposed outside of said Embedded Cavities 11 and 12 when stored inside said Embedded Cavities 11 and 12, thereby accommodating easy retrieval. Said "Ceiling" 13 is an effective barrier for preventing either of said Needles 21 or 22 from falling out of said Container 1, even though one said Needle 21 or 22 may be slightly farther down from said "Ceiling" 13 than the other. But as stated above, neither said Needle 21 nor 22 are an actual part of the invention.

I claim:

1. A container comprising a lid, a base, and an independently functioning exterior storage component, wherein said lid and said base comprise two opposite ends, wherein said lid and said base are hinge attached at one end, and releasably snap fit attached at an opposite end, and wherein said base defines an isolated interior storage compartment that can only be accessed by opening said lid; and wherein said independently functioning exterior storage component is separated from said base by a solid wall, and wherein said independently functioning exterior storage component has one or more vertically oriented, tube-shaped cavities through its top end that are each dimensioned as one-eighth inch in diameter by two and-three-eighths inches deep to store finishing needles, thereby permanently separating said finishing needles from other stored items in said base; said independently functioning exterior storage component further being hinge-attached to said base; said hinge attachment comprising a rotational hinge which allows said independently functioning exterior storage component to open by pivoting outwards from said base; and further comprising two protrusions located on said independently functioning exterior storage component and two complimentary socket elements located on said base so as to releasably snap-lock said independently functioning exterior storage component closed against said base.

* * * * *